United States Patent [19]

Morganson et al.

[11] Patent Number: 4,624,713

[45] Date of Patent: Nov. 25, 1986

[54] SOLID RINSE AIDS AND METHODS OF WAREWASHING UTILIZING SOLID RINSE AIDS

[75] Inventors: Stephen A. Morganson, S. St. Paul; Erin P. Schneeman, St. Paul, both of Minn.

[73] Assignee: Economics Laboratory, Inc., St. Paul, Minn.

[21] Appl. No.: 671,673

[22] Filed: Nov. 15, 1984

[51] Int. Cl.[4] ..... B67C 1/04

[52] U.S. Cl. ..... 134/25.2; 134/29; 252/174.15; 252/174.16; 252/174.21; 252/544

[58] Field of Search ..... 134/25.2, 26, 29; 252/DIG. 1, 544, 548, 174, 174.15, 174.16, 174.21; 260/96.5 C

[56] References Cited

U.S. PATENT DOCUMENTS

| | | | |
|---|---|---|---|
| 2,559,583 | 7/1951 | Barker | 252/152 |
| 2,559,584 | 7/1951 | Barker | 252/152 |
| 2,584,056 | 1/1952 | Soule et al. | 252/106 |
| 2,584,057 | 1/1952 | Soule et al. | 252/106 |
| 2,665,256 | 1/1954 | Barker | 252/152 |
| 2,724,699 | 11/1955 | Barker | 252/DIG. 1 X |
| 2,724,700 | 11/1955 | Barker | 252/137 |
| 2,727,025 | 12/1955 | Weitkamp | 260/96.5 |
| 3,082,172 | 3/1963 | Temple et al. | 252/89 |
| 3,272,899 | 9/1966 | Diamond et al. | 252/180 X |
| 3,580,850 | 5/1971 | Dupre | 252/99 |
| 3,741,912 | 6/1973 | Kaneko | 252/DIG. 1 X |
| 3,816,351 | 6/1974 | Lancz | 252/DIG. 1 X |
| 3,941,713 | 3/1976 | Dawson et al. | 252/82 X |
| 3,968,058 | 7/1976 | Cheng | 252/DIG. 1 X |
| 4,155,882 | 5/1979 | Davies et al. | 252/DIG. 1 X |
| 4,239,552 | 12/1980 | Perner et al. | 252/DIG. 1 X |
| 4,289,525 | 9/1981 | Pasarela et al. | 71/92 |
| 4,434,078 | 2/1984 | Kaneko | 252/357 |
| 4,447,343 | 5/1984 | May | 252/8.75 |

FOREIGN PATENT DOCUMENTS

| | | |
|---|---|---|
| 697315 | 9/1953 | United Kingdom . |
| 748877 | 5/1956 | United Kingdom . |

OTHER PUBLICATIONS

"Technical Data on Plurafac RA Surfactants for Low Foam Applications," BASF Wyandotte Corporation.

"Technical Data on Pluronic® Polyols," BASF Wyandotte Corporation.

*Primary Examiner*—Peter Hruskoci

*Attorney, Agent, or Firm*—Merchant, Gould, Smith, Edell, Welter & Schmidt

[57] ABSTRACT

Methods of warewashing utilizing a solid rinse aid, and the solid rinse aid which comprises a surfactant and urea, and preferably a dispensing rate adjusting additive, are disclosed.

12 Claims, No Drawings

SOLID RINSE AIDS AND METHODS OF WAREWASHING UTILIZING SOLID RINSE AIDS

FIELD OF THE INVENTION

The present invention relates to solid rinse aids and methods of warewashing wherein a solid rinse aid is used in a rinse cycle.

BACKGROUND OF THE INVENTION

Both institutional and consumer automatic dishwashers or warewashing machines have been in use for many years. These dishwashers typically function with two or more cycles, including various combinations of a soak or prewash, a main wash, a rinse, a sanitize and a dry cycle. A dishwasher detergent composition is typically utilized during the wash cycle to remove soil and stains. Often, the detergent composition will include water softeners, bleaching and sanitizing agents, and an alkali source.

For many reasons, separate rinse additives or aids are an important part of the automatic dishwasher operation. In general, rinse aids minimize spotting and promote faster drying, by causing the rinse water to sheet off of the clean dishes evenly and quickly. Rinse aids are generally used in a cycle separate from cycles using the detergent composition, although some detergent residue may be present in the rinse water.

Rinse aids are currently available in liquid or solid form. The use of a solid rinse aid can be much preferred. Solid rinse aids can be more convenient, safe and economical than liquids because they do not spill or splash. In addition, dispensers for solid rinse aids tend to be less expensive and more durable because generally they have no moving parts. However, many surfactants with good rinse performance are commonly available only in a liquid or paste form at room temperature. The invention provides solid rinse aids from liquid, paste-like, or solid surfactants.

Solid rinse aids are available for consumer and institutional warewashing machines. For use in a typical consumer machine, each solid rinse aid generally incorporates a disposable container or basket which is hung directly inside the machine. This container is also referred to as a dispenser. Circulation of water within the machine in the normal course of the machine cycles slowly dissolves the solid rinse aid, thus dispensing it. The water temperature in consumer machines typically falls between 60°-180° F.

Institutional machines are generally either low temperature machines with a water temperature of from about 120°-140° F., or high temperature machines with a water temperature of about 160°-180° F. A low temperature warewashing system can be more desirable than a high temperature system because it avoids the heating expenses associated with the hotter water. In addition, it is much simpler to dispense a rinse aid in a low temperature system. In a low temperature system, a quantity of rinse water can be added to the sump of the automatic dishwashing machine and circulated to rinse the dishes, before draining. In such a system, the rinse aid need only be provided to the sump, and will function as the water circulates.

By contrast, in a higher temperature system dissolved rinse aid is injected into the rinse water line prior to entering the machine and is then sprayed over the dishes from a rotation spray arm. A continuous stream of hot water is commonly provided through the spray arm for rinsing. Consequently, a rinse aid for use in a high temperature system must be dispensed into and sufficiently dissolved in the hot water stream against a back pressure before the water leaves the spray arm and contacts the dishes. This generally requires a more complex dispensing system.

There are two aspects to surfactant solubility which must be considered in the context of a solid rinse aid. First, the surfactant itself must be sufficiently water soluble to function as a rinse aid. This requires a surfactant solubility of at least about 5-10 ppm, or more commonly, about 40-80 ppm in water somewhere between 60°-180° F. depending upon the warewashing system. Many surfactants meet this requirement.

However, some slid surfactants, which in view of their solubility and performance could be very effective rinse aids, are not in use because their low water solubility prevents effective dispensing. This illustrates the second and more important aspect of solubility, namely, the surfactant must be soluble enough to dispense in an effective quantity during the short time that water impinges the solid to dispense it. For example, a solid surfactant may be soluble enough to function as an effective rinse aid if an appropriate amount were dissolved in the rinse water; however, if an attempt were made to dispense the solid into the rinse water in the typical way, that is, by solubilziing a portion through impingement with a brief water spray, the solid may not solubilize quickly enough to be useful. In the context of this invention, the solid rinse aid (which may have been formed of a solid, paste-like, or liquid surfactant according to the invention) is soluble enough to dispense in an effective amount, even if the surfactant alone would be too insoluble for effective dispensing.

BRIEF DESCRIPTION OF THE INVENTION

We have found that a solid rinse aid can be formed from a urea occlusion composition or compound which comprises urea and a surfactant and can be used in methods of warewashing to achieve desirable results. The solid rinse aid and methods of use reduce spotting of the dishes, and promote faster drying by allowing the rinse water to sheet off of the clean dishes quickly and evenly. The solid rinse aid can be formed of surfactants which generally exist as a liquid, semi-solid or solid at room temperature. In addition, the solid rinse aid compositions of this invention can have increased solubility as compared to the surfactants themselves which are utilized in the rinse aids, allowing the utilization of surfactants which are generally too water insoluble to function well as rinse aids, or to be appropriately dispensed.

DETAILED DESCRIPTION OF THE INVENTION

A major component of the solid rinse aids of the invention is the surfactant or surfactant system. The surfactants useful in the context of this invention are generally polyether (also known as polyalkylene oxide, polyoxyalkylene or polyalkylene glycol) compounds. More particularly, the polyether compounds are generally polyoxypropylene or polyoxyethylene glycol compounds. Typically, the surfactants useful in the context of this invention are synthetic organic polyoxypropylene-polyoxyethylene block copolymers. The surfactant molecules must have a particular stereo chemistry which facilitates occlusion by or with urea, as discussed in more detail hereinafter. As a general rule, the useful surfactants will have a molecular weight in the range of about 700 to 14,000.

Certain types of polyoxypropylene-polyoxyethylene block copolymer surfactants have been found to be particularly useful. Those surfactants comprising a center block of polyoxypropylene units (PO), and having a block of polyoxyethylene (EO) units to each side of the center PO block, are generally useful in the context of this invention, particularly where the average molecular weight ranges from about 900 to 14,000, and the percent of weight EO ranges from about 10 to 80. These types of surfactants are sold commercially as "Pluronics" by the BASF Wyandotte Corporation, and are available under other trademarks from other chemical suppliers.

Also useful in the context of this invention are surfactants having a center block of polyoxyethylene units, with endblocks of polyoxypropylene units. These types of surfactants are known as "Reverse Pluronics", also available from Wyandotte.

Alcohol ethoxylates having EO and PO blocks can also be useful in the context of this invention. Straight chain primarily aliphatic alcohol ethoxylates can be particularly useful since the stereo chemistry of these compounds can permit occlusion by urea, and they can provide effective sheeting action. Such ethoxylates are available from several sources, including BASF Wyandotte where they are known as "Plurafac" surfactants. A particular group of alcohol ethoxylates found to be useful are those having the general formula $R—(EO)_m(PO)_n$, where m is an integer around 5, e.g. 2–7, and n is an integer around 13, e.g. 10–16. R can be any suitable radical, such as a straight chain alkyl group having from about 8 to 18 carbon atoms.

Another compound found to be useful is a surfactant having the formula $$R—\overset{\overset{\displaystyle O}{\|}}{C}—O—(EO)_m(PO)_m(EO)_m(PO)_m,$$

wherein m is an integer from about 18–22, preferably 20, and the surfactant has a molecular weight of from about 2,000 to 3,000, preferably about 2,500, a percent EO of about 36 to 44, preferably about 40, and where R is a straight chain alkyl group having from about 8 to 18 carbon atoms.

Certain surfactants have been found to be particularly preferred for use in this invention, in view of the ease with which they combine with urea to form the solid rinse aids of the invention, and for the exceptionally effective sheeting action they provide as rinse aids. One of the most preferred surfactants is a block copolymer of the structure $$(PO)_n(EO)_n(EOPO)_n(PO)_m(EOPO)_n(EO)_n(PO)_n,$$

where m is an integer from 1–3 and each occurrence of n, independently, is an integer from 17–27, and EOPO represents a random mixture of EO and PO units at a ratio of EO to PO of from about 6:100 to 9:100. Most preferably, the copolymer will be of the structure $$(PO)_{23}(EO)_{26}(EOPO)_{20}(PO)_1(EOPO)_{20}(EO)_{26}(PO)_{23},$$

where EOPO represents a random mixture of EO and PO units at a ratio of EO to PO of about 7:93. The preferred compound has an average molecular weight of between about 3,500–5,500, preferably about 4,500, and a weight percent of EO of about 25–35%, preferably about 30%.

A preferred combination comprises the above-described copolymer having blocks of randomly mixed EO and and PO units, and a surfactant having the formula (PO)(EO)(PO)(EO)(PO), with molecular weight of around 1,800–2,200 and a percent EO of about 25–30%. Preferably, the ratio of one copolymer to the other will range from about 2:1 to 0.5:1. Most preferably, the combination will comprise around 50% of each of the two copolymers.

Another preferred surfactant system comprises from about 20 to 80% of the copolymer having blocks of randomly mixed EO and PO units previously described, from about 1–5% of a nonylphenolethoxylate, and from about 20 to 80% of a surfactant having the formula $$R—\overset{\overset{\displaystyle O}{\|}}{C}—O—(EO)_m(PO)_m(EO)_m(PO)_m,$$

wherein m is an integer from about 18–22, preferably 20, and the surfactant has a molecular weight of from about 2,000 to 3,000, preferably about 2,500, a percent EO of about 36 to 44, preferably about 40, and where R is a straight chain alkyl group having from about 8 to 18 carbon atoms. More preferably, the components will be present in amounts of from 45 to 50%, 2 to 4%, and 45 to 50%, respectively.

The surfactant or surfactant system will comprise up to about 95% by weight of the total rinse aid composition. Typically, the weight-percent surfactant will be in the range of about 60–90%, or more preferably, for improved rinse aid formation and sheeting action, in the range of about 80–90%.

Urea

Solid rinse aid compositions of this invention comprise a urea occlusion composition of an effective occlusion forming amount of urea and a compatible surfactant as previously described. It is theorized that the urea reacts with the surfactant to form crystalline urea adducts or occlusion compounds, wherein the urea molecules are wrapped in a spiral or helical formation around the molecules of surfactant. Generally, urea will form occlusion compounds with long straight-chain molecules of 6 or more carbon atoms but not with branched or bulky molecules.

The solid rinse aid compositions of this invention can comprise up to about 40% by weight urea. Typically, the compositions will have a minimum of about 5% urea. We have found that the preferred compositions, for reasons of economy, desired hardness and solubility, comprise about 8 to 40% urea. Most preferably, the compositions generally comprise about 10 to 15% urea.

Urea may be obtained from a variety of chemical suppliers, including Sohio Chemical Company, Nitrogen Chemicals Division. Typically, urea will be available in prilled form, and any industrial grade urea may be used in the context of this invention.

Water

The composition of this invention further comprises water, to aid in the occlusion reaction, by solubilizing the urea. The composition of the invention should comprise sufficient water to solubilize the urea. Typically, this requires a water:urea ratio greater than about 1:6. More preferably, for more effective formation and performance of the solid rinse aid, the water:urea ratio will be from about 1:3 to 1:5, and most preferably, about 1:4. Tap water, distilled water, deionized water or the like may be used. Water is the preferred solvent because of its nontoxicity and ready availability.

Dispensing Rate Adjusting Additive

Preferably, the solid rinse aid compositions of the invention include an effective dispensing rate modifying amount of a urea compatible additive, or dispensing rate adjusting additive. A dispensing rate adjusting additive is generally needed to provide for the desired rate of solubilization, when the solid rinse aid is in use.

Many factors, or dispensing variables, affect the rate of of solubilization or release of the surfactant from the solid rinse aid. We have found that the four major variables which affect the dispensing rate of this invention in either consumer or institutional uses are the temperature of the incoming water, pressure of the rinse water, length of time of the cycle during which water contacts the solid rinse aid to solubilize it, and, in a consumer setting, the design of the dispenser which may shield portions of the solid rinse aid from direct contact with the circulating water, or in an institutional setting, the presence and design of a screen in the dispenser between the solid rinse aid and the spray nozzle which directs water to the solid rinse aid. While these variables can be adjusted to more nearly provide the desired dispensing rate, nevertheless we have found it desirable to include a dispensing rate adjusting additive within the composition itself. Use of the solid rinse aid which includes a dispensing rate adjusting additive according to this invention generally provides acceptable dispensing through the dispenser under typical conditions found in consumer and institutional use. The variables such as temperature, pressure, time and a screen can then be adjusted if necessary to obtain more precisely the dispensing rate preferred in a particular situation.

We have found that without a dispensing rate adjusting additive, the solid rinse aids of the invention can dispense more rapidly than necessary or desired. Consequently, we recommend that an effective dispensing rate modifying amount, (generally up to about 5% for institutional uses and up to 30% for consumer uses), of a urea compatible dispensing rate adjusting additive be included in the solid rinse aid compositions of this invention. Generally, any organic low molecular weight water insoluble additive which would not interfere with rinse performance may be utilized as the dispensing rate adjusting additive. Preferred additives include lauric acid, myristic acid, palmitic acid, stearic acid, oleic acid, alkanolamide compounds such as stearic or palmitic alkanolamide, silicone dimethyl polysiloxane compounds, and free acids of organic phosphate esters.

A most preferred dispensing rate adjusting additive comprises a phosphate ester of cetyl alcohol often available as a mixture of mono and di-cetyl phosphates. This preferred additive is generally available as a nontoxic, nonhazardous solid or powder from well known chemical suppliers. This additive provides good dispensing rate modification and also has good defoaming properties. Defoaming properties are useful particularly for low temperature warewashing machines, because in low temperature machines the rinse water is used in the succeeding wash cycle, where defoaming is particularly desirable.

For institutional solid rinse aids, the additive may be used in quantities up to about 5% by weight of the total solid rinse aid composition. More preferably, it will be used in sufficient quantity to form about 0.3–1.0% by weight of the total composition, particularly where a phosphate ester of cetyl alcohol is used and where the dispenser is subjected to a rinse water temperature of about 120° to 180° F., water pressure of around 10–60 p.s.i., and a dispensing cycle of about 0.5 to 15 seconds. With or without a typical screen, generally the solid rinse aid will then dispense at a rate of about 0.3 to 0.8 grams per dispensing cycle, a rate we have found to be desirable for reasons of both effective sheeting action and economy in a typical institutional warewashing machine having one rack for dishes and providing about 2½ gallons of rinse water in which the rinse aid of each dispensing cycle will be dissolved. A particularly preferred rate is around 0.35–0.45, or about 0.4 grams per cycle. Expressed as parts per million, this dispensing provides a concentration of about 32 to 85 p.p.m. rinse aid in the rinse water. More preferably, the concentration will be between about 37 to 48, or around 41–43 p.p.m.

For the consumer product, the additive is used in quantities up to about 30% by weight of the total composition. Preferably the additive will be used to form about 3–30% of the total composition, or more preferably, about 5–10%. In consumer uses, the solid rinse aid is simply hung within the dishwashing machine. It is solubilized by the action of water circulating through the machine, regardless of the cycle, and dispenses to some extent throughout the prewash, main wash, etc. However, the product is designed to dispense in the final rinse in a quantity sufficient to provide the desired sheeting performance. Under typical consumer conditions such as rinse water temperature of about 60–160° F., water pressure of about 10–100 p.s.i., and a final rinse time of about 2 to 10 minutes, the product will generally dispense at a rate of about 0.3–0.8 grams per final rinse cycle, or preferably, at around 0.35–0.45, or about 0.4 grams. As in the institutional setting, this typically provides a concentration of rinse aid in the rinse water of about 32 to 85 p.p.m. More preferably, the concentration will be between about 37 to 48, or most preferably, around 41–43 p.p.m.

Other Components

The solid rinse aid compositions of the invention may also include components such as dyes, preservatives and the like.

Dyes provide for a more pleasing appearance of the rinse aid. Any water soluble dye which does not interfere with the other desirable properties of the invention may be used. Suitable dyes include Fastusol Blue, available from Mobay Chemical Corp., Acid Orange 7, available from American Cyanamid, Basic Violet 10, available from Sandoz, Acid Yellow 23, available from GAF, Sap Green, available from Keystone Analine and Chemical, Metanil Yellow, available from Keystone Analine and Chemical, Acid Blue 9, available from Hilton Davis, Hisol Fast Red, available from Capitol Color and Chemical, Fluorescein, available from Capitol Color and Chemical, and Acid Green 25, available from Ciba-Geigy.

While preservatives typically are not necessary in the context of this invention, they may be included where desired. Suitable preservatives include formaldehyde, glutaraldehyde, methy-p-hydroxybenzoate, propyl-p-hydroxybenzoate, chloromethyl isophthiozolinone, methyl isophthiozolinone, and a $C_{12}$, $C_{11}$, $C_{16}$ dimethylbenzyl aluminum chloride such as that available as Hyamine 3500 from Rohm & Haas, and the like. Suitable preservatives may be obtained from a variety of well known chemical suppliers.

Where used, these additional components can be provided in quantities as well known in the art.

Method of Preparation

The solid rinse aids of the invention can be prepared by any suitable procedure. We have found the following procedure to be preferable. First, the surfactant is charged into a suitable steam jacketed mixing vessel. If the surfactant is a solid, it is melted either before placing it in the vessel, or after placing it in the vessel but before the addition of water. As the surfactant is mixed, the water is slowly and continuously added. When the water has been added, the resulting solution is heated by pressurized steam, with mixing, to approximately 110° F. The urea is then slowly added, as the heating and mixing continues. With the addition of the urea, the viscosity of the mixture increases and the mix speed is adjusted accordingly. The dispensing rate adjusting additive, dye, preservative and other components are added, with continued mixing.

After the addition of these components, the mixture continues to be mixed and heated until it reaches about 220° F. To avoid water loss, urea degradation and the release of ammonia, at about 220° F. the source of heat is removed. Cooling is initiated by adding water to the steam jacket. The mixing continues.

Mixing should be continued with cooling to at least about 180° F. At about 180° F. or less, the mixture can be poured into containers and allowed to cool to room temperature, at which time it will be relatively solid. With time (2–4 days), the product cures or hardens.

The container may be formed of plastic material such as polyethylene, polypropylene, or the like, or any other suitable material. For convenient use in typical currently available institutional warewashing machines, it is suggested that the shape or form of the container be cylindrical, with a height of about 4 to 8 inches and a diameter of about 1 to 4 inches. For consumer purposes, the container can surround the solid rinse aid dispenser or basket, so that the composition solidifies directly in the dispenser. For the consumer product, it is suggested that the container be cylindrical in shape, about 2 inches high and about 1 inch in diameter.

The containers can be individual molds which may be provided with removable tightly sealed covers and which may serve as packaging for the solid rinse aid.

It is of course also envisioned that the solid rinse aids may be removed from the containers for repackaging prior to sale.

Method of Use

The solid rinse aids of the invention may be utilized in warewashing systems without monitoring the concentration of active ingredient in the rinse water. The composition itself has a great impact on the dispensing rate and thus the concentration.

The solid rinse aids of the invention are formulated to dispense at a rate of about 0.3–0.8, or preferably about 0.35–0.45, grams per cycle under typical warewashing rinse conditions. These conditions have been discussed previously, and include about 2.5 gallons of rinse water. For machines utilizing about 5 gallons of rinse water, such as double rack institutional machines, the dispensing rate, expressed in grams per cycle, should be double. Expressed as parts per million, the rinse aid should dispense at an appropriate rate to provide a rinse aid concentration in the rinse water of about 32 to 85 p.p.m., more preferably about 37 to 48, or most preferably, around 41–43 p.p.m.

In an institutional low temperature system, the solid rinse aid is placed in a dispenser where water to be added to the rinse water impinges the solid rinse aid before it enters the machine. Typically, this means that water sprays through a spray nozzle onto the product and dissolves some of the product, providing an effluent. The effluent is directed by gravity to the warewashing machine, where it commonly collects in a sump and is circulated and recirculated over the dishes.

In an institutional high temperature system, the rinse water is sprayed onto the dishes through a spray arm of the machine. In the use of this invention, the rinse water sprays first through a spray nozzle onto the product, providing an effluent, which then flows into a holding tank and is then pumped into the line which brings the hot rinse water into the spray arm.

In a consumer machine, the solid rinse aid in its dispenser is hung or otherwise placed within the machine. Circulating water (regardless of the cycle) dissolves and distributes some of the product.

In all three uses, the active ingredients of the solid rinse aid are dissolved in the rinse water and act upon the dishes during rinsing.

The invention will be further understood by reference to the following Examples which include the preferred embodiment.

EXAMPLE I

Into a 5 gallon steam jacketed ELB mixing vessel was charged 33.84 lbs. or 84.6% by weight of the total composition of a polyoxyethylene/polyoxypropylene glycol surfactant having the structure $$(PO)_{23}(EO)_{26}(EOPO)_{20}(PO)(EOPO)_{20}(EO)_{26}\text{-}(PO)_{23}$$

wherein EOPO represents a random mixture of ethylene oxide and propylene oxide units at a ratio of EO to PO of about 7:93, having an average molecular weight of about 4500 and a weight % of EO of about 30%. Mixing was begun at a speed of about 100 r.p.m. using a Lightnin mixer, and continued until the ultimate product was poured into molds. After 30 minutes, 1.7 lbs. or about 3.0% by weight of the total composition tap water was gradually added. When the addition of water was completed, the solution was heated using steam. When the temperature reached about 110° F., without discontinuing heating, 4.8 lbs. or about 12.0% by weight of the total composition prilled urea was slowly added. With the addition of urea, the viscosity of the solution increased and the mix speed was increased accordingly.

Mixing and heating continued until the solution reached 220° F. The source of heat was then immediately removed. After removal of the solution from the heating source, 72.5 g. or about 0.4% by weight of the total composition of a mixture of mono and diphosphate esters of cetyl alcohol, and about 1.09 g. or 0.006% by weight of the total composition of Fastusol Blue dye were added.

Mixing continued while the solution was allowed to cool. When the temperature of the solution reached about 180° F., it was poured into 16 oz. cylindrical containers and allowed to harden in the molds at room temperature for approximately 4 days.

A solid rinse aid from the above batch was tested for performance as follows.

Six substrates (one each of china, melamine, glass plate, steel, knife, and glass tumbler) were appropriately placed in a Hobart FW-60-SR low temperature warewashing machine, a machine typical of those currently in use in institutional settings. A solid rinse aid formed above was utilized at concentrations of 50 p.p.m., 100 p.p.m., 150 p.p.m., and 200 p.p.m. as follows: a portion of a solid rinse aid formed above was weighed out, placed in a beaker and dissolved in water. This solution was added to the warewashing machine to achieve the desired concentrations.

The rinse aid solutions at the desired concentrations were cycled over the substrates for thirty seconds. Upon visual inspection of the substrates after cycling at each concentration, the solid rinse aid was rated for sheeting action as follows: 0=no sheeting, 1=partial sheeting, 2=complete sheeting.

Thus, the maximum value for sheeting action would be 12, indicating total sheeting on all six substrates.

Results were as follows:

| p.p.m. | Sheeting Action |
|---|---|
| 50 | 12 |
| 100 | 10 |
| 150 | 10 |
| 200 | 10 |

The sheeting action of 10 was due to partial sheeting on the melamine and glass plate substrates.

These results indicate very effective rinse aid performance.

EXAMPLE II

Solid rinse aids were made as in Example I, but without any dispensing rate adjusting additive, i.e. without mono and diphosphate esters of cetyl alcohol.

After formation and hardening, 4 samples, 2A through 2D, were tested for dispensing rate. Each sample was weighed, then placed in the dispenser of a Hobart FW-60-SR low temperature warewashing machine. The machine was operated by means of a timer which cycled water to the dispenser precisely as would occur during rinsing. The cycles were 3 seconds in length, and 10 cycles were conducted with respect to each sample.

After cycling, the remaining block of solid rinse aid was removed from the dispenser and dried by allowing any excess water to drain away, at ambient conditions, for about 15 minutes. The solid rinse aid was then weighed.

The difference in weight of the solid rinse said before cycling and after cycling, divided by the number of cycles, provided the average dispensing rate.

Each sample was tested at both 140° F., and 120° F. The dispensing rate results were as follows:

| Sample | 140° F. Dispensed* | 120° F. Dispensed* |
|---|---|---|
| 2A | 0.48 grams | 0.84 grams |
| 2B | 0.76 grams | 0.78 grams |
| 2C | 0.57 grams | 0.61 grams |

-continued

| Sample | 140° F. Dispensed* | 120° F. Dispensed* |
|---|---|---|
| 2D | 0.64 grams | 0.57 grams |

*Per 3-second cycle

EXAMPLE III

Three batches of solid rinse aid were prepared as in Example I, but instead of adding 0.4% by weight of a mixture of mono and diphosphate esters of cetyl alcohol, were added 1%, 3%, and 5%, respectively, for formulations 3A, 3B, and 3C.

The solid rinse aids were tested for dispensing rate as in Example II, except that instead of cycling 10 times, a sample of each solid rinse aid was cycled a minimum of 20 times, at a water temperature of 130° F.

The results were as follows:

| Sample | 130° F. Dispensed* |
|---|---|
| 3A | 0.3 grams |
| 3B | 0.18 grams |
| 3C | 0.05 grams |

*per 3-second cycle

This Example illustrates the effectiveness of a dispensing rate adjusting additive in modifying the dispensing rate. In this surfactant and urea combination, a five fold increase in the amount of the cetyl alcohol esters reduced the dispensing rate by a factor of six.

The foregoing description and Examples are exemplary of the invention. However, since persons skilled in the art can make various embodiments without departing from the spirit and scope of the invention, the invention is embodied in the claims hereinafter appended.

We claim:

1. A method of warewashing, including at least a wash water cycle and a rinse water cycle, which comprises dispensing, in a rinse cycle, an effective amount of a surfactant from a water soluble solid block rinse aid said rinse aid consisting essentially of:

(a) about 5–40% by weight urea;

(b) about 60–90% by weight of a polymeric synthetic organic surfactant having a molecular weight of about 700–14,000 comprising a polyethylene oxide block and a polypropylene oxide block; and (c) sufficient water to provide a water:urea weight ratio of about 1:3 to 1:6.

2. The method of claim 1 wherein the solid block rinse aid comprises about 5–15% by weight urea.

3. The method of claim 2 wherein the solid block rinse aid comprises about 80–90% by weight surfactant.

4. The method of claim 1 wherein the polyether compound is a polyoxyethylene/polyoxypropylene glycol polymer.

5. The method of claim 4 wherein the polyoxyethylene/polyoxypropylene glycol polymer has the structure (PO)hd $n(EO)_n(EOPO)_n(PO)_m(EOPO)_n$-$(EO)_n(PO)_n$ where PO represents propylene oxide units and EO represents ethylene oxide units, EOPO represents a random mixture of ethylene oxide and propylene oxide units at a ratio of EO to PO of about 6:100 to 9:100, m is an integer from 1–3, each occurrence of n, independently, is an integer from 17–27, and where the polymer has an average molecular weight of between about 3,500–5,500 and a weight percent of EO of about 25–35%.

6. The method of claim 1 wherein the solid rinse aid further comprises an effective dispensing rate modifying amount of a urea compatible additive.

7. The method of claim 6 wherein the additive comprises a low molecular weight substantially water-insoluble compound.

8. The method of claim 7 wherein the additive comprises an alkanolamide compound, lauric acid, myristic acid, palmitic acid, stearic acid, oleic acid, a silicone dimethyl polysiloxane compound, a free acid of an organic phosphate ester compound, or mixtures thereof.

9. The method of claim 7 wherein the additive comprises a cetyl alcohol phosphate ester compound.

10. The method of claim 6 wherein the additive is present in the solid rinse aid at up to about 30% by weight of the solid rinse aid.

11. The method of claim 10 wherein the additive is present in the solid rinse aid at up to about 5% by weight of the solid rinse aid.

12. The method of claim 1 wherein the polymeric synthetic organic surfactant is an aliphatic alcohol alkoxylate or an aliphatic carboxylic acid alkoxylate.

* * * * *